US005765769A

United States Patent [19]

Kaya

[11] Patent Number: 5,765,769

[45] Date of Patent: Jun. 16, 1998

[54] METHOD FOR ADJUSTMENT OF JAW CRUSHER TOGGLE BLOCK, AND DEVICE USED THEREIN

[75] Inventor: Takato Kaya, Tokyo, Japan

[73] Assignee: Kotobuki Engineering & Manufacturing Co., Ltd., Tokyo, Japan

[21] Appl. No.: 553,550

[22] PCT Filed: Apr. 6, 1995

[86] PCT No.: PCT/JP95/00667

§ 371 Date: Dec. 15, 1995

§ 102(e) Date: Dec. 15, 1995

[87] PCT Pub. No.: WO95/31285

PCT Pub. Date: Nov. 23, 1995

[30] Foreign Application Priority Data

May 17, 1994 [JP] Japan ..... 6-126909

[51] Int. Cl.[6] ..... B02C 1/02

[52] U.S. Cl. ..... 241/264; 241/267; 241/268

[58] Field of Search ..... 241/264, 267, 241/268, 269, 266, 36, 37

[56] References Cited

U.S. PATENT DOCUMENTS

| | | | |
|---|---|---|---|
| 27,882 | 4/1860 | Blake | 241/269 |
| 419,294 | 1/1890 | Spiers et al. | 241/269 |
| 650,105 | 5/1900 | Bacon | 241/269 X |
| 1,945,853 | 2/1934 | Gustafson . | |
| 2,566,583 | 9/1951 | Shelton . | |
| 3,326,479 | 6/1967 | Connolly et al. | 241/268 |
| 3,511,444 | 5/1970 | Vitez | 241/264 X |
| 4,165,044 | 8/1979 | Batch | 241/364 |
| 4,765,546 | 8/1988 | Stewart | 241/36 |
| 4,783,013 | 11/1988 | Polzin | 241/219 |
| 4,927,089 | 5/1990 | Altmayer | 241/264 |

*Primary Examiner*—John M. Husar

*Attorney, Agent, or Firm*—Nikaido, Marmelstein, Murray & Oram LLP

[57] ABSTRACT

The objective of this invention is to provide a method to adjust the position of a jaw crusher toggle block, and a device used for said method; wherein the said device can adjust the cavity width over a wide range, and can be applied to a wide range of jaw crushers, including large models, without itself having to be enlarged. This invention is a novel method to adjust the position of the toggle block of a jaw crusher in which the toggle block supports one end of a toggle plate that is connected at the other end to the bottom of the swinging jaw; with said method using a device comprised of a displacement block that is positioned on the back face of the toggle block and moves in the same lateral direction as the toggle block, and a pair of hydraulic cylinders, connected to the toggle block at the two ends that lie perpendicular to its lateral direction of motion in a manner such that the cylinders expand or contract in the said lateral direction of motion of the toggle block; wherein the said displacement block is moved forward to displace the toggle block towards the toggle plate, and the said hydraulic cylinders are contracted to further pull forward the toggle block, and seams are inserted into the gap that forms between the back face of the toggle block and the front face of the displacement block.

13 Claims, 3 Drawing Sheets

METHOD FOR ADJUSTMENT OF JAW CRUSHER TOGGLE BLOCK, AND DEVICE USED THEREIN

BACKGROUND OF THE INVENTION

1. Field of Invention

This invention relates to a method to adjust the position of the toggle block in a double toggle or single toggle jaw crusher, and a toggle block sliding device used therein.

2. Description of Prior Art

A jaw crusher is a typical crushing machine that can be used for the primary breaking of rocks as excavated. An example of a double toggle jaw crusher is shown in FIG. 3. Excavated rocks are scooped into the crushing cavity 12 formed between the fixed jaw 1 and the swinging jaw 11, and are broken by the impelling force of the swinging jaw.

The swinging jaw 11 is suspended from the swinging jaw shaft 13 as the fulcrum, and swings with the movement of the pitman 21 moving up and down with the rotation of the eccentric shaft 2, and the toggle mechanism on either side of pitman. In this case, a double toggle mechanism is formed from the jaw toggle plate 22 that connects the swinging jaw 11 and pitman 21, and the frame toggle plate 24 that connects the pitman 21 and toggle block 23.

A safety device to guard against uncrushable objects, and an adjustment device to adjust the gap between the fixed jaw 1 and swinging jaw 11, thereby controlling the degree of crushing, are set on the frame toggle plate side. This cavity width adjustment device slides the toggle block 23 back and forth by the movement of a wedge 25, and by means of the frame toggle plate 24, pitman 21, and jaw toggle plate 22, adjusts the forward and backward position of the swinging jaw 11.

A single jaw crusher has no pitman 21 nor jaw toggle plate 22, and the eccentric shaft 2 serves a dual function as the swinging jaw shaft 13.

DETAILED EXPLANATION OF INVENTION

Objective of this invention

The objective of this invention is to provide a method to adjust the position of a jaw crusher toggle block, and a device used for that method; wherein the device can adjust the cavity width over a wide range, and can be applied to a wide range of jaw crushers, including large models, without itself having to be enlarged.

Problems to be resolved by this invention

As described, conventionally a wedge 25 is pushed in to slide the toggle block 23, but this configuration restricts the range of adjustment, and is difficult to apply to a large jaw crusher. To obtain a wider adjustment range, the dimensions of the sliding mechanism, including the wedge, would have to be enlarged, necessitating an enlargement of the entire jaw crusher configuration.

Means to resolve these problems

This invention is a novel method to adjust the position of the toggle block of a jaw crusher in which the toggle block supports one end of a toggle plate that is connected at the other end to the bottom of the swinging jaw; with said method using a device comprised of a displacement block that is positioned on the back face of the toggle block and moves in the same lateral direction as the toggle block, and a pair of hydraulic cylinders, connected to the toggle block at the two ends that lie perpendicular to its lateral direction of motion in a manner such that the cylinders expand or contract in the said lateral direction of motion of the toggle block; wherein the said displacement block is moved forward to displace the toggle block towards the toggle plate, and the hydraulic cylinders are contracted to further pull forward the toggle block, and seams are inserted into the gap that forms between the back face of the toggle block and the front face of the displacement block.

Further, this invention is a novel jaw crusher toggle block sliding device used as the device to adjust the position of the toggle block, in which the sliding device supports one end of a toggle plate that is connected at the other end to the bottom of the swinging jaw; wherein said device is comprised of a displacement block that is positioned on the back face of the toggle block and moves in the same lateral direction as the toggle block, and a pair of hydraulic cylinders, connected to the toggle block at the two ends that lie perpendicular to its lateral direction of motion in a manner such that the cylinders expand or contract in the said lateral direction of motion of the toggle block; wherein the said displacement block is moved forward to displace the toggle block, and the hydraulic cylinders are contracted or expanded to enable the toggle block to slide forward or backward.

In the jaw crusher toggle block sliding device, the said displacement block is comprised of a planar face that contacts the back face of the toggle block, and a tapered segment formed from sloped faces on the reverse side of the planar face, wherein a wedge interlocking with the said tapered segment is moved in a direction perpendicular to the lateral movement of the toggle block, thereby causing the displacement block to move forward or backward.

Also, in the jaw crusher toggle block sliding device, the displacement block is comprised of a planar face that contacts the back face of the toggle block, and a pyramid segment formed from two sloped faces on the reverse side of the planar face, wherein two wedges interlocking with each sloped face are moved towards each other or apart from each other, in a direction perpendicular to the lateral movement of the toggle block, thereby causing the displacement block to move forward or backward.

Moreover, in the jaw crusher toggle block sliding device, relief valves are set in the hydraulic fluid circuit of the hydraulic cylinders, wherein the relief valves are adjusted such that the hydraulic cylinders will bear a specified percentage of the load required to move the toggle block, and the balance of the load is borne by the displacement block.

Effectiveness of this invention

Given the configuration and action as described above, this invention is effective because once the displacement block reaches its limiting position, the hydraulic cylinders are contracted to further pull the toggle block forward, wherein a gap is formed between the planar face of said displacement block and the back face of the toggle block, into which a suitable number of seams are inserted. This configuration enables the position of the toggle block to be adjusted over a wide range without having to enlarge the dimensions of the adjustment device, and can even be applied to large jaw crushers.

SIMPLIFIED EXPLANATION OF DIAGRAMS

EXAMPLE

An example of one embodiment of this invention is explained below, with reference to the diagrams. This explanation is for a double toggle jaw crusher, but the invention can also be applied to a single toggle jaw crusher.

Configuration of toggle block sliding device

Figure 2:
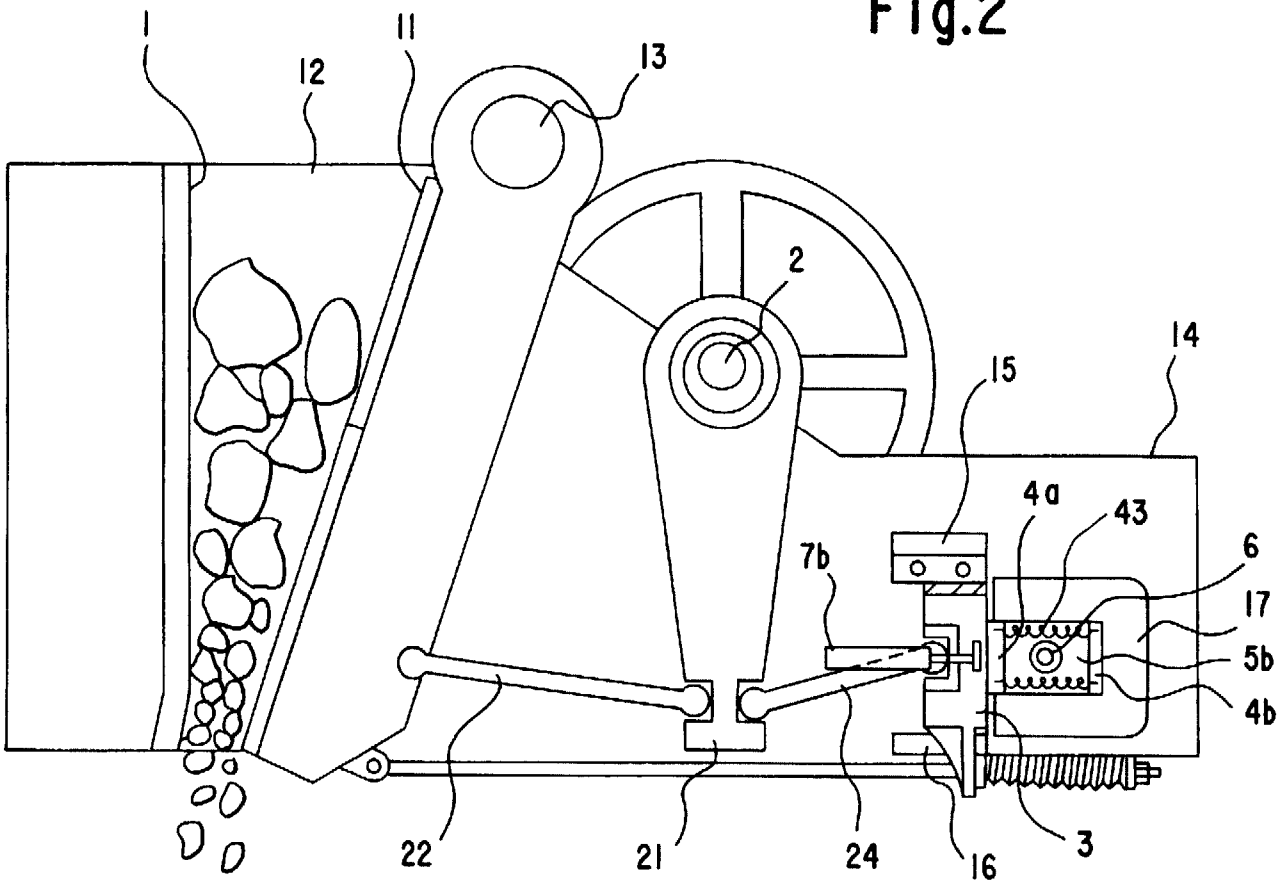
FIG. 2 is an explanatory diagram of the entire configuration of one embodiment of the device of this invention.
Figure 3:
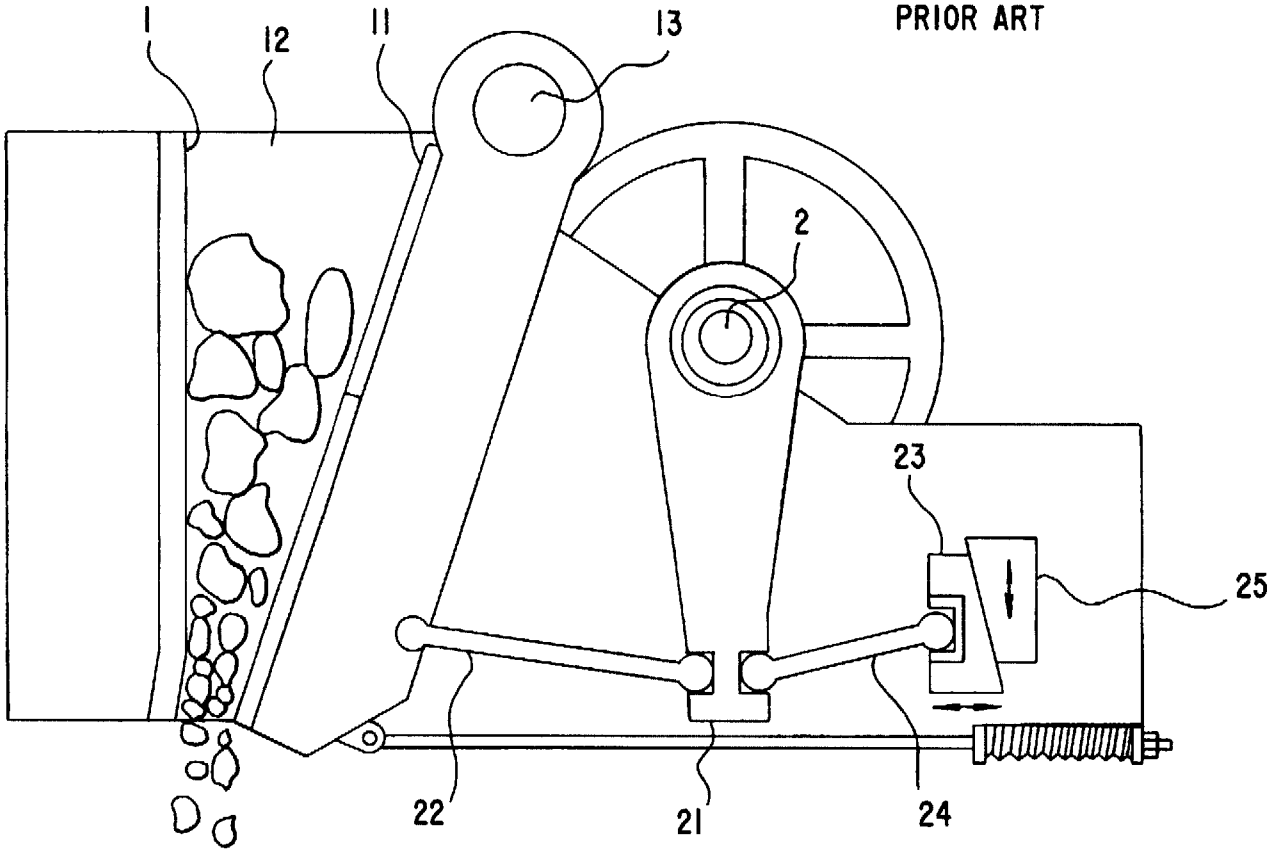
Fig.3 PRIOR ART
FIG. 3 is an explanatory diagram of the conventional technique.

As shown in FIG. 2, the toggle block 3 is sandwiched between the upper support member 15 and lower support member 16, arranged like shelves and joined to the main machine frame 14. One end of the frame toggle plate 24 is connected to this toggle block 3. During normal crushing operation, this toggle block remains fixed in position.

The frame toggle plate 24, pitman 21, jaw toggle plate 22, swinging jaw 11, and fixed jaw 1 are of conventional configuration, and hence an explanation is omitted here.

The cavity width adjustment device is set inside the housing 17 joined to the frame 14 on the back side of the toggle block 3. This housing 17 is open on that side facing the toggle block 3 and houses the displacement block 4*a*, facing block 4*b*, two wedges 5*a*, 5*b*, and screw rod 6.

Figure 1:
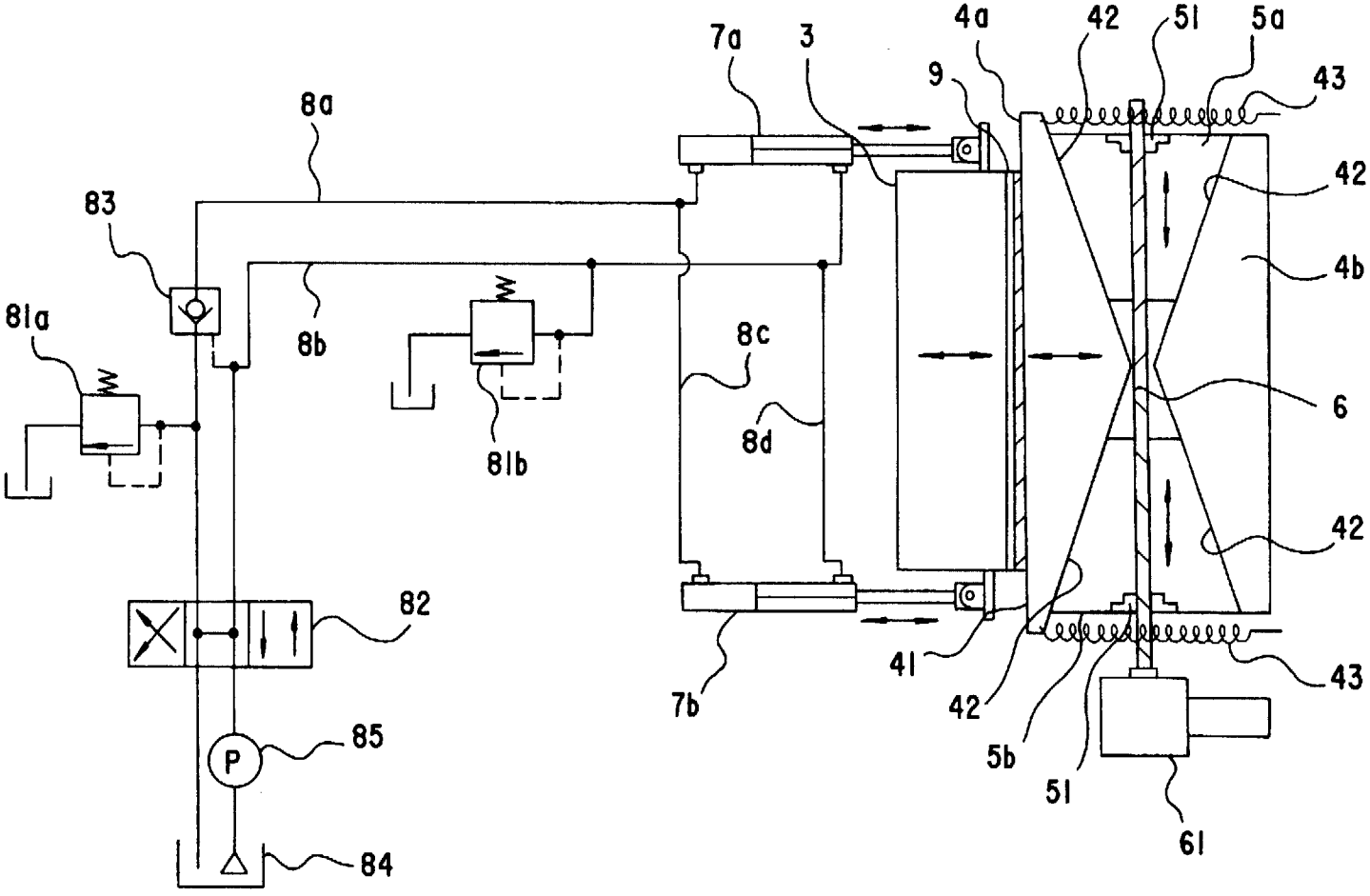
FIG. 1 is a schematic explanatory diagram of one embodiment of the device of this invention.

As shown in FIG. 1, the displacement block 4*a* abuts against the back face of toggle block 3, and is comprised of a planar face 41 and two sloped sides 42, 42 on the opposite face that form a pyramid. Springs 43, 43 are mounted on either end of displacement block 4*a*, each energized in the direction of facing block 4*b*. This facing block 4*b* is comprised of two sloped sides 42, 42 to form a mirror image of, and set at a specified distance from, the pyramid segment of the displacement block 4*a*.

Wedges 5*a*, 5*b* are positioned between the displacement block 4*a* and facing block 4*b* with each wedge being of a shape formed by the two opposing sloped sides 42, 42 thereof. A trapezoidal screw 51, 51 is mounted in the center of each wedge 5*a*, 5*b*, and a screw rod 6 is screwed through the central axis formed by the trapezoidal screws 51, 51, and wedges 5*a*, 5*b*. One end of said screw rod 6 is connected to a rotating drive motor 61.

One end of two hydraulic cylinders 7*a*, 7*b* is connected to each end of the toggle block 3 that is perpendicular to its lateral movement, wherein the hydraulic cylinders expand and contract in the direction of the lateral movement of the toggle block 3.

An example of the hydraulic fluid circuit 8*a*, 8*b* of hydraulic cylinder 7*a* is shown in FIG. 1. Relief valves 81*a*, 81*b*, and a switching valve 82 are set in the circuits, check valve 83 is set between the hydraulic cylinder 7*a* of hydraulic circuit 8*a* and relief valve 81*a*; and a hydraulic pump 85 is set on the hydraulic tank 84 side of hydraulic fluid circuit 8*b*.

Hydraulic fluid circuits 8*c*, 8*d* of the other hydraulic cylinder 7*b* are connected to hydraulic fluid circuits 8*a*, 8*b* respectively between the hydraulic cylinder 7*a* and relief valves 81*a*, 81*b*. The relief valves 81*a*, 81*b* can be adjusted such that hydraulic cylinders 7*a*, 7*b* will bear a specified percentage of the load required to move the toggle block 3. In this case, the displacement block 4*a* can bear the remaining load, thus reducing wear of the motor 61 that rotates the screw rod 6.

Method to adjust position of toggle block

As the liners of the fixed jaw 1 and swinging jaw 11 wear out, the cavity width becomes too wide, in which case, the toggle block 3 can be moved forward to narrow the gap. In this case, the motor 61 is started to rotate the screw rod 6 to drive the wedges 5*a*, 5*b* closer together, thereby causing the displacement block 4*a* to advance and displace the toggle block 3 forward; at the same time hydraulic cylinders 7*a*, 7*b* are contracted, and the two actions together cause the toggle block 3 to advance.

When the displacement block 4*a* reaches its limiting position, the hydraulic cylinders 7*a*, 7*b* are contracted further to advance the toggle block 3 to the required position.

This action causes a gap to form between the planar face 41 of the displacement block 4*a* and the back face of the toggle block 3, for which a suitable number of seams 9 are inserted. Accordingly, the impelling force transmitted to the toggle block 3 during crushing can be transferred to the back side of the toggle block.

To reverse the toggle block 3, the screw rod 6 is rotated in the reverse direction to drive the wedges 5*a*, 5*b* apart, and the displacement block 4*a* is pulled back with the compressive force of the return springs 43, 43; at the same time the hydraulic cylinders 7*a*, 7*b* are expanded to push back the toggle block 3, and the two actions together cause the toggle block 3 to reverse.

We claim:

1. A toggle block sliding device for a jaw crusher having a toggle block supporting one end of a toggle plate that is connected at the other end to a bottom of a swinging jaw; said device comprising a displacement block positioned on a back face of the toggle block and moveable in a same lateral direction as the toggle block, said displacement block including a planar face opposite the back face of said toggle block and a tapered segment formed of sloped faces on a side of said displacement block opposite said planar face, at least one wedge engaging said tapered segment and moveable in a direction parallel to said planar face, and means for moving said at least one wedge in said parallel direction.

2. A toggle block sliding device as claimed in claim 1, further including a pair of hydraulic cylinders connected to the toggle block at lateral sides of the toggle block perpendicular to a direction of motion of the toggle block, said cylinders being expandable and contractible in the direction of motion of the toggle block, a plurality of shims placeable between said displacement block and said back face of the toggle block, and a system for expanding and contracting said pair of hydraulic cylinders to both take up part of a load on said toggle block during operation of the jaw crusher and to move said toggle block to permit insertion and removal of at least one of said shims.

3. A jaw crusher toggle block sliding device as claimed in claim 2, wherein said system for expanding and contracting said pair of hydraulic cylinders includes relief valves set in a hydraulic fluid circuit for said hydraulic cylinders, said relief valves being adjusted such that the hydraulic cylinders will bear a specified percentage of the load required to move the said toggle block, with the balance of the load being borne by said displacement block.

4. A toggle block sliding device for a jaw crusher having a toggle block supporting one end of a toggle plate that is connected at the other end to a bottom of a swinging jaw; said device comprising a displacement block positioned on a back face of the toggle block and moveable in a same lateral direction as the toggle block, said displacement block including a planar face opposite the back face of said toggle block and a pyramid segment formed of two sloped faces meeting at an apex on a side of said displacement block opposite said planar face, two wedges engaging said pyramid segment and moveable in a direction parallel to said planar face, and means for moving said two wedges in synchronism in said parallel direction.

5. A toggle block sliding device as claimed in claim 4, further including a facing block mounted on the jaw crusher having a shape the same as said pyramid segment and having an apex facing said apex of said pyramid segment, said two wedges engaging both said facing block and said pyramid segment of said displacement block.

6. A toggle block sliding device as claimed in claim 5, wherein said means for moving said two wedges in synchronism in said parallel direction comprises a screw rod engaged with said two wedges and an drive driving the screw rod moving the two wedges toward or away from each other which in turn moves the displacement block relative to the facing block.

7. A toggle block sliding device as claimed in claim 6, further including at least one spring connected to the displacement block and biasing said displacement block closer to the facing block.

8. A toggle block sliding device as claimed in claim 5, further including at least one spring connected to the displacement block and biasing said displacement block closer to the facing block.

9. A toggle block sliding device as claimed in claim 5, further including a pair of hydraulic cylinders connected to the toggle block at lateral sides of the toggle block perpendicular to a direction of motion of the toggle block, said cylinders being expandable and contractible in the direction of motion of the toggle block, a plurality of shims placeable between said displacement block and said back face of the toggle block, and a system for expanding and contracting said pair of hydraulic cylinders to both take up part of a load on said toggle block during operation of the jaw crusher and to move said toggle block to permit insertion and removal of at least one of said shims.

10. A jaw crusher toggle block sliding device as claimed in claim 9, wherein said system for expanding and contracting said pair of hydraulic cylinders includes relief valves set in a hydraulic fluid circuit for said hydraulic cylinders, said relief valves being adjusted such that the hydraulic cylinders will bear a specified percentage of the load required to move the said toggle block, with the balance of the load being borne by said displacement block.

11. A toggle block sliding device as claimed in claim 4, further including a pair of hydraulic cylinders connected to the toggle block at lateral sides of the toggle block perpendicular to a direction of motion of the toggle block, said cylinders being expandable and contractible in the direction of motion of the toggle block, a plurality of shims placeable between said displacement block and said back face of the toggle block, and a system for expanding and contracting said pair of hydraulic cylinders to both take up part of a load on said toggle block during operation of the jaw crusher and to move said toggle block to permit insertion and removal of at least one of said shims.

12. A jaw crusher toggle block sliding device as claimed in claim 11, wherein said system for expanding and contracting said pair of hydraulic cylinders includes relief valves set in a hydraulic fluid circuit for said hydraulic cylinders, said relief valves being adjusted such that the hydraulic cylinders will bear a specified percentage of the load required to move the said toggle block, with the balance of the load being borne by said displacement block.

13. A jaw crusher toggle block sliding device having a toggle block supporting one end of a toggle plate that is connected at the other end to a bottom of a swinging jaw; said device comprising a displacement block positioned on a back face of the toggle block and moveable in a same lateral direction as the toggle block, said displacement block including a planar face opposite the back face of said toggle block and a pyramid segment formed of two sloped faces meeting at an apex on a side of said displacement block opposite said planar face, two wedges engaging said pyramid segment and moveable in a direction parallel to said planar face, means for moving said two wedges in synchronism in said parallel direction, said means for moving said two wedges in synchronism in said parallel direction comprising a screw rod engaged with said two wedges and an drive driving the screw rod moving the two wedges toward or away from each other which in turn moves the displacement block relative to the facing block, a facing block mounted on the jaw crusher having a shape the same as said pyramid segment and having an apex facing said apex of said pyramid segment, said two wedges engaging both said facing block and said pyramid segment of said displacement block, at least one spring connected to the displacement block and biasing said displacement block closer to the facing block, a pair of hydraulic cylinders connected to the toggle block at lateral sides of the toggle block perpendicular to a direction of motion of the toggle block, said cylinders being expandable and contractible in the direction of motion of the toggle block, a plurality of shims placeable between said displacement block and said back face of the toggle block, and a system for expanding and contracting said pair of hydraulic cylinders to both take up part of a load on said toggle block during operation of the jaw crusher and to move said toggle block to permit insertion and removal of at least one of said shims, said system for expanding and contracting said pair of hydraulic cylinders includes relief valves set in a hydraulic fluid circuit for said hydraulic cylinders, said relief valves being adjusted such that the hydraulic cylinders will bear a specified percentage of the load required to move the said toggle block, with the balance of the load being borne by said displacement block.

* * * * *